United States Patent [19]

Takahashi et al.

[11] 4,184,927

[45] Jan. 22, 1980

[54] PROCESS AND APPARATUS FOR EFFECTING SURFACE TREATMENT OF WORKPIECES

[75] Inventors: Toshiro Takahashi, Shizuoka; Masashi Ikegaya, Haibara, both of Japan

[73] Assignee: Riken Keikinzoku Kogyo Kabushiki Kaisha, Shizuoka, Japan

[21] Appl. No.: 865,361

[22] Filed: Dec. 29, 1977

[30] Foreign Application Priority Data

Dec. 30, 1976 [JP] Japan ..... 51-159891
Mar. 23, 1977 [JP] Japan ..... 52-31096

[51] Int. Cl.[2] ..... C25D 11/16; C25D 17/06

[52] U.S. Cl. ..... 204/33; 204/204; 204/205

[58] Field of Search ..... 204/33, 198, 202–205

[56] References Cited

U.S. PATENT DOCUMENTS

| | | | |
|---|---|---|---|
| 2,558,090 | 6/1951 | Jernstedt | 204/205 |
| 2,979,181 | 4/1961 | Abbey | 198/19 |
| 3,929,593 | 12/1975 | Sugiyama et al. | 204/35 N |
| 3,968,020 | 6/1976 | Nagano et al. | 204/203 |

*Primary Examiner*—John H. Mack
*Assistant Examiner*—William Leader
*Attorney, Agent, or Firm*—Finnegan, Henderson, Farabow & Garrett

[57] ABSTRACT

Workpieces vertically suspended on carrier bars in side-by-side relation are dipped into an electrolyte bath which has a plurality of electric contact plates of alternating polarity spaced along one side. Electric energy is applied to the workpieces from the plates through the carrier bars and the successive work pieces serve as electrodes of opposite polarity, the polarities reversing as the individual carrier bars are advanced from plate to plate.

6 Claims, 10 Drawing Figures

PROCESS AND APPARATUS FOR EFFECTING SURFACE TREATMENT OF WORKPIECES

This invention relates to a process and an apparatus for effecting surface treatment of workpieces, such as extruded aluminum members, and more particularly to a process and an apparatus for providing uniform coatings on such aluminum metal members.

It is sometimes required to anodize surfaces of extruded aluminum members for use in window frames, for example. Further, these members are normally used with protective and decorative resin coatings which are provided thereon. In a conventional apparatus for surface treatment of the workpieces, a plurality of electrolytic baths is disposed parallelly to form anodic oxidation on the surfaces of the workpieces and a complicated conveyor system for transfer of the workpieces from one bath to another is used. In accordance with the conventional process using a plurality of baths, the workpieces to be treated are stationarily placed in each bath during the process of surface treatment in such manner that current necessary to form anodic oxidation thereon is applied between an electric contact plate fixed to a wall of the bath and the workpieces in the bath. Accordingly, the number of the workpieces to be treated per one electrolytic bath is restricted and the conventional manner is not suitable to effectively carry out the surface treatment of a large amount of the workpieces.

In accordance with this invention, a plurality of electric contact plates is disposed along one wall of an electrolytic bath in such a manner that one is spaced away from another and has a polarity different from the next contact plate on each side. A plurality of workpieces vertically suspended in side-by-side relationship on a carrier bar, the adjacent workpieces serving as electrodes of opposite polarities, is continuously transferred into an electrolytic bath and advanced therein. During the advance of the workpieces in the bath, the carrier bars comes into contact with the electric contact plates one after another so as to alternately reverse the polarities of the workpieces. Thus, oxidation may be formed on the surfaces of the workpieces during the movement thereof in the bath.

The present invention has an object to provide a process and an apparatus for enabling continuous surface treatment of vertically suspended members.

Another object of the present invention is to provide a process and an apparatus for forming oxidation on surfaces of workpieces during advance thereof in an electrolytic bath.

The above and other object of the present invention will become apparent from the following description of a preferred embodiment having reference to the accompanying drawings, in which.

Figure 1:
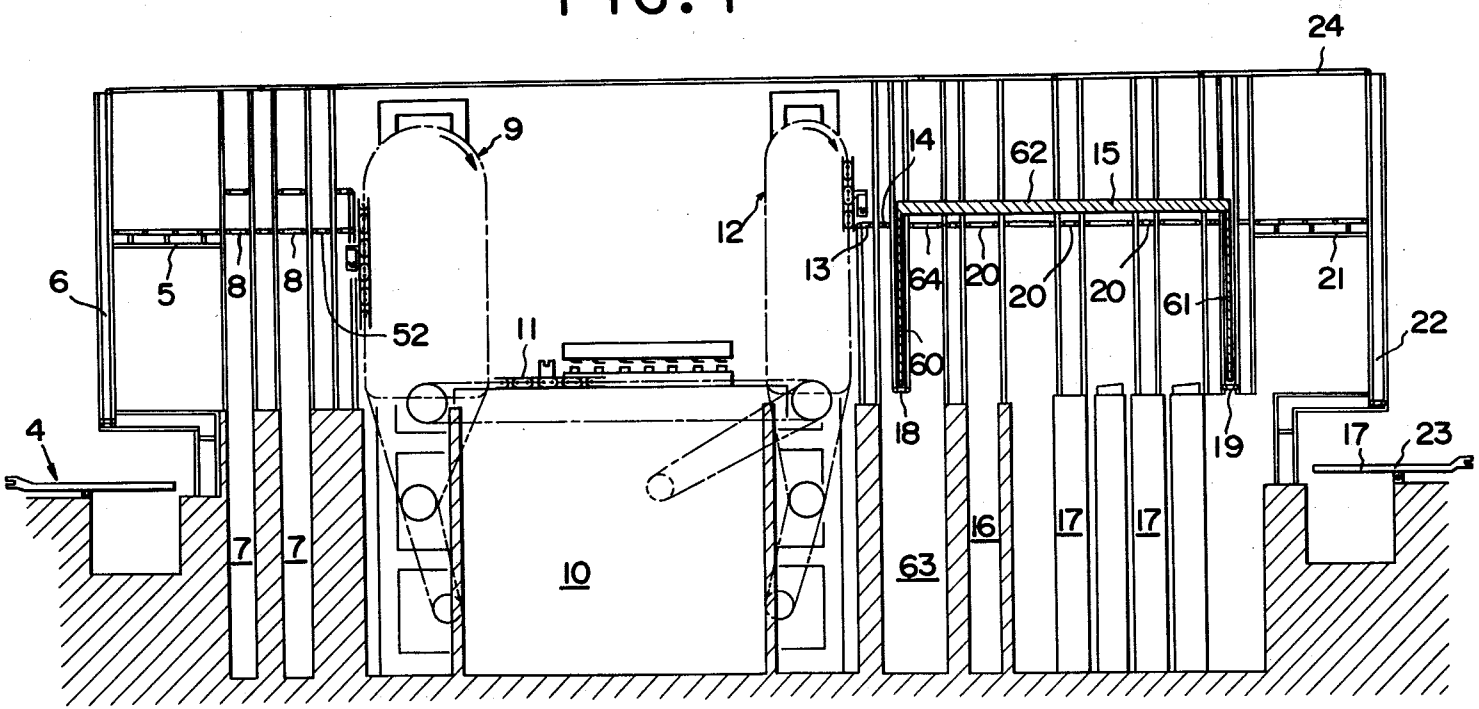
FIG. 1 is a vertical sectional view of the apparatus; and showing the general flow of workpieces or members to be treated in the apparatus.

Referring to FIG. 1, which shows one side of apparatus in accordance with the present invention (the other side of the apparatus being symmetrical with that illustrated except parts mentioned hereinafter) the apparatus 1 has an erectable loading frame 4 having an end for receiving a carrier bar or hanger 3 which is adapted to carry a plurality of elongate members or workpieces 2 (FIG. 2) in side-by-side relationship to be treated. First lifting means 6 receive a carrier bar 3 having an elongate workpiece 2 suspended thereunder from the loading frame 4 and transport the bar 3 vertically upwardly towards longitudinal conveying means 5 above the loading frame 4. Second lifting means 8 receives the carrier bar 3 conveyed by the conveying means 5 and transport it vertically into and out of a treating bath 7 beneath the lifting means 8. First chain conveyor means 9 receives the carrier bar 3 and transports it into an electrolytic bath 10. Second chain conveyor means 11 receives the carrier bar 3 conveyed by the first chain conveyor 9 and advances it at a constant speed. Third chain conveyor means 12 receives the carrier bar 3 conveyed by the second carrier bar 11 and transports it vertically out of the bath 10. Conveyor 13 receives the bar 3 conveyed by the third chain conveyor means 12 and transfers it to conveyor 14 which is vertically moved along a frame. Enclosure means 15 defines an insulated heating chamber above coating baths 16 and baking furnaces 17. Conveyor 18 conveys the bar 3 into the heating chamber. A further conveyor 19 conveys the bar 3 now carrying coated workpieces out of the chamber. A conveyor 20 moves the bar 3 vertically and also longitudinally into the heating chamber. A still further conveyor 21 transports the bar longitudinally from the conveyor 19. A third lifting means 22 receives the bar 3 from the conveyor 13 and transports it vertically downwardly. An unloading frame 23 is movable between a vertical position and a horizontal position and has an end for receiving the carrier bar 3 from the third lifting means when in its vertical position. The frame 23 is then moved into a horizontal position where the treated workpieces are removed from the carrier bar. A return conveyor 24 is provided at an upper portion of the apparatus, and it extends longitudinally throughout the length of the apparatus. The unloading frame 23, carrying a carrier bar 3 from which workpieces are removed as described above, is again moved to its vertical position where the bar 3 is again picked up by the third lifting means 22 and moved upwardly into the returning conveyor 24 by which it is returned to the loading portion of the apparatus.

Figure 2:
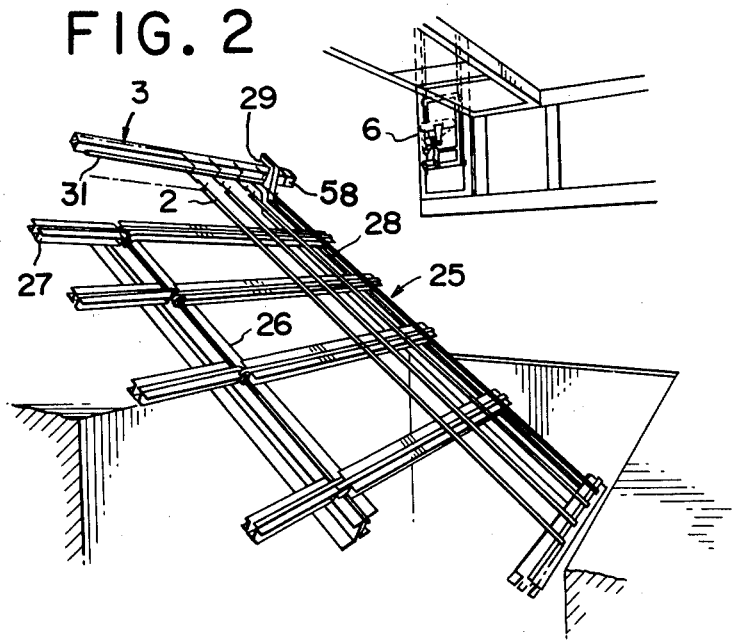
FIG. 2 is a perspective view showing the erectable mechanism in a partially erected position.

Referring to FIG. 2, since frame 4 is symmetrical with respect to the longitudinal center-line thereof and identical with that appearing in U.S. Pat. No. 3,968,020, its structure will be illustrated with respect to only one side thereof and described briefly. The frame 4 includes a rectangular main frame structure 25 made of interconnected extrusion members, and a longitudinally extending centre spar 26. The main frame structure 25 has longitudinal members 28 each having one end projecting beyond a transverse member 27. The projecting end of longitudinal member 28 has an open-top groove 29 for receiving the carrier bar 3 with workpieces suspended therefrom. Between the longitudinal member 28 and the centre spar 26 there may be disposed a plurality of transversely-extending belt conveyors, driven by a motor (not shown). A suitable number of rollers can be provided beneath the belt of the conveyors, for supporting the load on the belt. The frame 4 is pivotally mounted on the base at about the centre of the longitudinal member 28, and means is provided for moving the frame 4 between horizontal and vertical positions in which the grooved ends of the longitudinal members 28 are directed upwardly.

Figure 3:
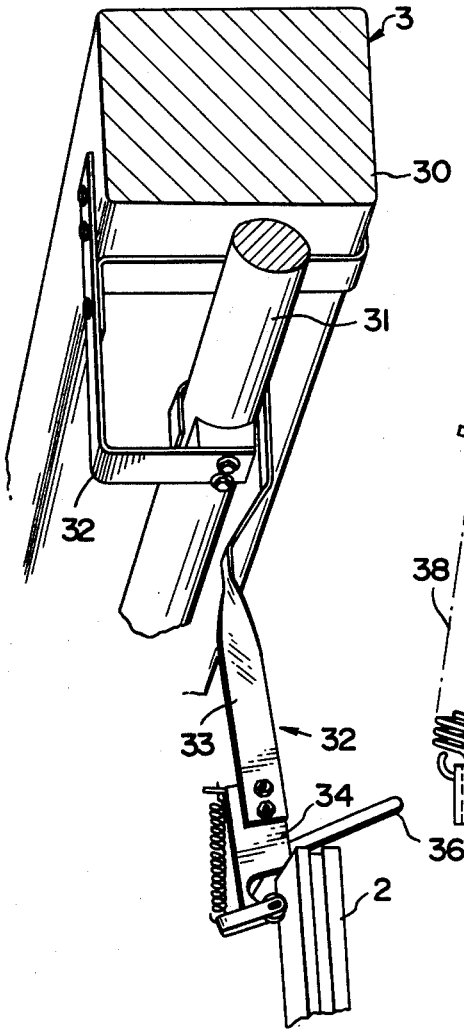
FIG. 3 is a fragmentary perspective view showing a part of a carrier bar for suspending members to be treated.

As best seen in FIG. 3, the carrier bar 3 for suspending elongate members or workpieces 2 includes a main bar body 30, which is preferably of rectangular cross-section and made of an electrically non-conductive material, and an electrically conductive rod 31 of circular cross-section which is spaced from the main bar body 30 and connected thereto by connecting members 32. The conductive rod 31 is connected to electrically conductive plates on the opposite end surfaces of the main bar body 30.

Figure 4:
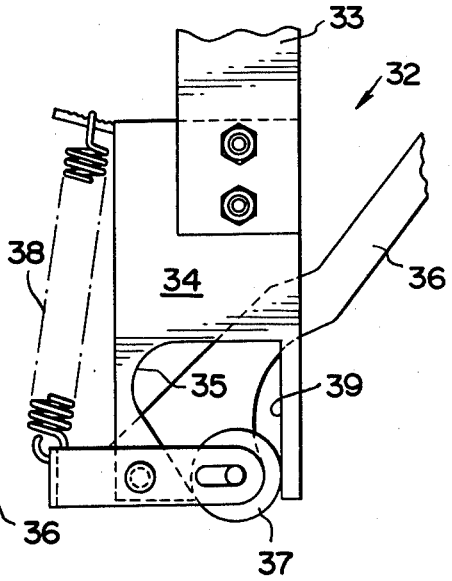
FIG. 4 is a fragmentary side elevational view of suspending device.

Referring to FIGS. 3 and 4, a suitable number of suspending devices 32 engage rod 31 for suspending workpieces 2. The devices 32 include a suspending member 33 with one end engaged with the rod 31 and the other end secured to a main plate member 34. The member 34 has a cutout 35, and a lever 36 is pivotal on member 34. Lever 36 carries a roller 37 which is positioned in the cutout 35. A spring 38 connected to lever 36 biasses lever 36 so that roller 37 is urged towards the opening in cutout 35. The cutout 35 is of such a shape that it has a straight portion 39 parallel to the bottom edge of member 34 and an inclined portion extending from the opening. The opening is slightly smaller than the diameter of the roller 37, so that the roller 37 is prevented from being disengaged from the cutout.

In loading a workpiece, lever 36 is actuated to move roller 37 along the inclined portion, so that a space is provided between roller 37 and the straight portion 39. One end of the workpiece is then inserted into the cutout, and the lever 36 is released. The workpiece is thereby frictionally gripped in the cutout 35 between the roller 37 and the straight portion 39. When the workpiece is suspended vertically, the weight of the workpiece 2 and friction between the roller 37 and the workpiece 2 cause the roller 37 to move towards the opening of the cutout 35, resulting in an increased gripping force.

Members 33 and 34, and the roller 37, are of electrically conductive materials. Member 33 is preferably of copper, and member 34 and roller 37 are preferably of a copper alloy such as a copper-titanium alloy or a copper-beryllium alloy. These copper alloys have been found satisfactory in respect of conductivity, resistance to chemical agents, and mechanical strength.

Figure 6:
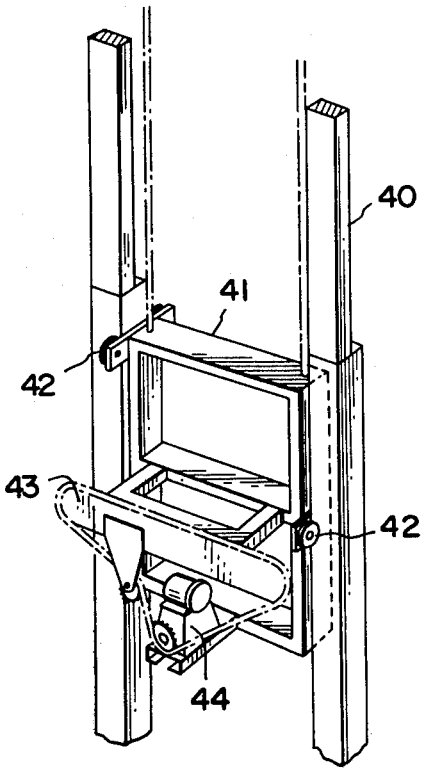
FIG. 6 is a view showing the hoisting means in detail.

The first lifting means 6 serves to receive a carrier bar 3 from the frame 4 when it is in the vertical position, and to transport it vertically upwardly. Means 6 also serves to receive an empty carrier bar 3 from the returning conveyor 24 and convey it downwardly into groove 29 of the frame 4. The lifting means 6 includes a vertical frame structure 40, and a movable frame assembly 41 having rollers 42 for sliding vertical movement along the frame structure 40 (see FIG. 6). The movable frame assembly 41 has a conveyor assembly 43 and a power source 44 therefor. The movable frame assembly 41 is moved vertically upwardly, or downwardly by a motor (not shown) to receive the carrier bar 3 from the loading frame 4 and transport it to the conveyor 5.

Figure 5:
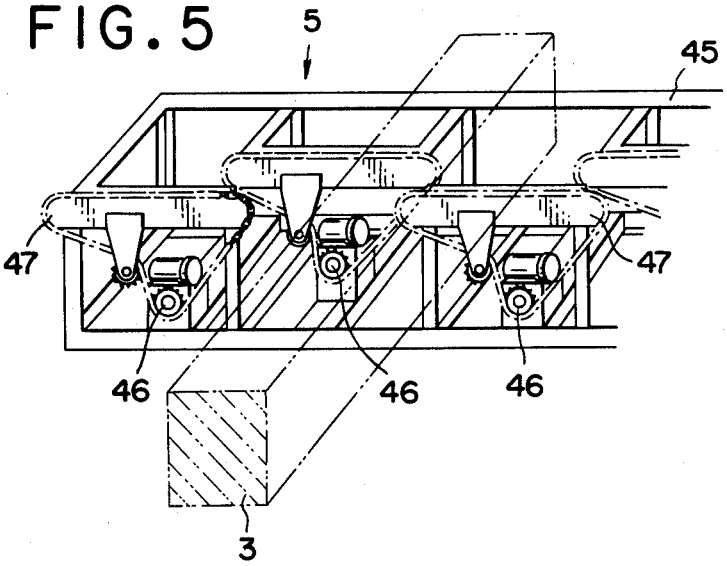
FIG. 5 is a perspective view showing a longitudinal conveying mechanism.

The conveyor 5 (FIG. 5) includes a longitudinal framework 45 extending perpendicularly out of the frame structure 40 and supporting the frame assemblies 41, each of which has a motor 46 and a chain conveyor 47 driven by the motor 46. Electrical control means prevent the succeeding conveyor from being operated when a carrier bar 3 is on the preceding conveyor, which prevents the succeeding carrier bar 3 from colliding with the preceding carrier bar 3.

The second lifting means 8 serves to receive a carrier bar 3 from the conveyor 5 and transport it vertically downwardly. The second lifting means 8 includes a vertically movable crane. The crane is constructed in a identical manner to the first lifting means 6, and it includes a frame assembly 41 with a motor 44 and a chain conveyor 43 driven by the motor.

Figure 8:
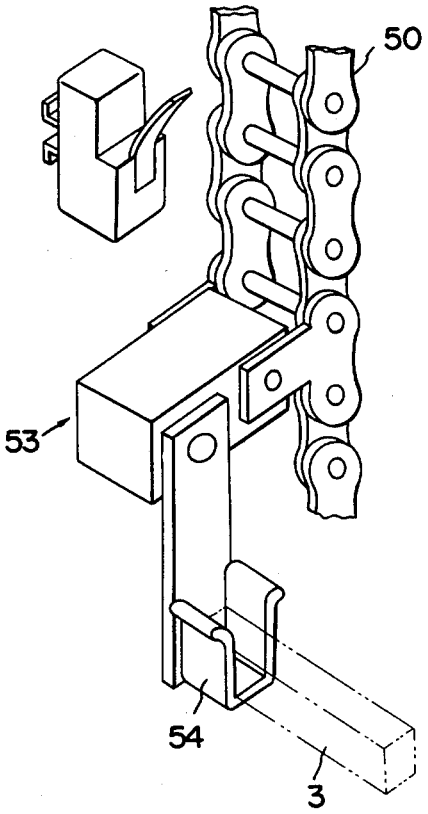
FIG. 8 is a fragmentary perspective view of a chain.
Figure 7:
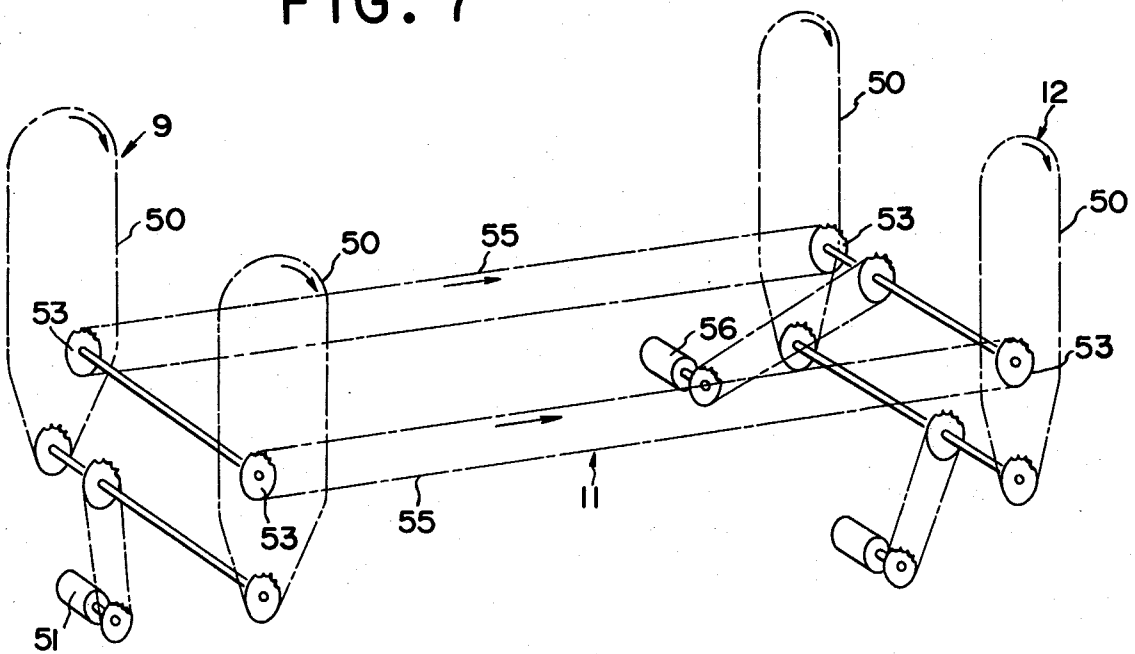
FIG. 7 is a view showing arrangement of a chain conveyor.

First chain conveyor means 9 includes endless chains 50 (FIGS. 7 and 8) which are oppositely disposed, vertical to the bath 10 and actuated by a motor 51. The path of the chains 50 is beyond the level of the conveyor 5 so as to receive the carrier bar 3 from a conveyor 52 the construction of which is substantially the same as that of the conveyor 5. Each chain 50 has a carriage 53 with a receiver 54 adapted to receive the end of the carrier bar 3. The carrier bar 3, suspending a plurality of workpieces 2 from the conveyor 52, is received by the receivers 54 and moved upwardly. Then, the carrier bar 3 is transferred downwardly along the path of the chains 50 and the workpieces are placed in the electrolytic bath 10.

Second chain conveyor means 11 receives the carrier bar 3 from the first chain conveyor 9. The second chain conveyor means 11 includes opposite chains 55 which run between and around sprockets **55*a* and extend parallel to and above the side walls of the bath 10. The sprockets are driven by a motor 56**.

Figure 10:
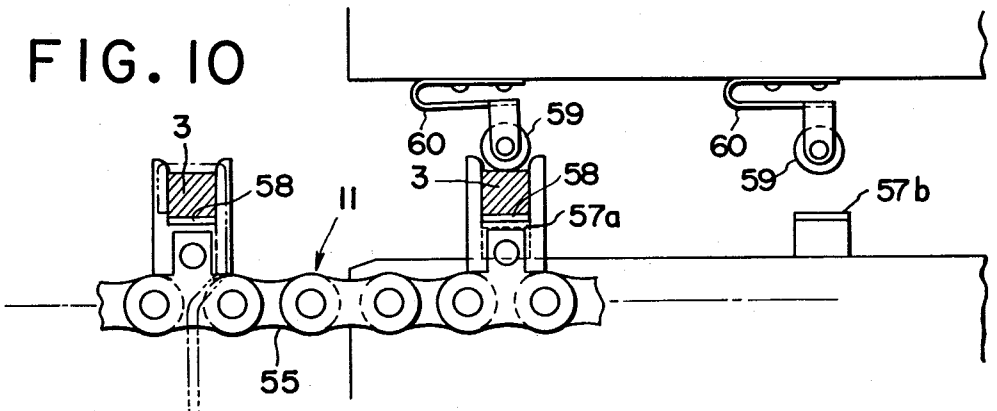
FIG. 10 is a fragmentary side view of the chain conveyor.
Figure 9:
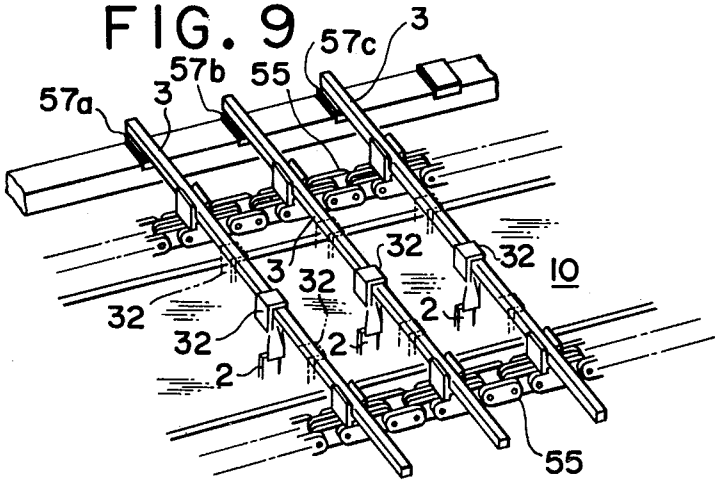
FIG. 9 is a fragmentary perspective view showing movement of the carrier bar.

Actuation of the chains 55 causes the workpieces in the bath to be moved forwardly. During advance of the carrier bar 3 along the path of the chains 55, electrical conductive material 58 (FIGS. 9 and 10) secured to the end of the carrier bar 3 comes into contact with electrical contact plates **57*a*, 57*b*, 57*c* . . . one after another so as to apply electrical energy to the workpieces 2 through the members 33, 34, 37. The period of time of electrical contact with the plates 57*a*, 57*b* . . . and the member 58 is predetermined in such a manner that the anodizing process is satisfactorily performed. It is preferable to interrupt the movement of the carrier bar 3 and to urge the carrier bar 3 against the receiver 54 through a roller 59 rotatably attached to a leaf spring member 60 while at least one of the plates 57*a*, 57*b* . . . is in engagement with the electrical conductive material 58**.

It is to be noted that each electrical contact plate **57*a*, 57*b*, 57*c*. . . is spaced away from the others and disposed along one side of the bath. Further, it is to be noted that first plate 57*a* is connected to a source of negative electricity and next plate 57*b* is connected to a source of positive electricity, the third plate 57*c* being negative, the forth plate 57*d* positive, etc. It should be understood that the polarity of the workpieces is reversed alternately in order during the movement thereof in the bath 10 and preceding workpieces are used as a counter electrode for succeeding workpieces, that is, each pair of workpieces suspended from the carrier bar 3** opposed in parallel serves as a pair of electrodes with opposed poles.

The solution in the electrolytic bath contains organic acid of sulfuric, oxalic, malonic or maleic, mixed acid of aromatic sulfonic acid of sulfosalicylic, sulfophthalic, phenolsulfonic or naphthalene sulfonic and sulfuric acid or of oxalic acid and sulfuric acid, or alkaline solution of phosphoric acid, chromic acid, sodium hydroxide, sodium phosphate. It may be possible to use either direct or pulse wave current. When the direct current is used, each polarity conversion period is about 0.2 sec.–5 min., preferably about 10–30 sec. Voltage value may be selectively used according to colors of anodic oxidation films to be formed. When non-colored anodic oxidation film is desired, voltage may be within the range of about 5–25 V. When brown colored film is desired, voltage is about 25–120 V. Density of the current depends on voltage value, but generally, its range is about 0.5–5 $A/dm^2$, preferably of about 1–1.5 $A/dm^2$. When the pulse current is used, each polarity conversion period is about 0.2 sec.–5 min., preferably about 10–30 sec. The conditions of the pulse wave include pulse width J of 16 m.sec.–512 m.sec., peak voltage $V_p$ of 5–95 V, base voltage $V_B$ of 0–90 V, n value (cycle/pulse width) of 2–7.

After anodizing treatment of the workpieces, the carrier bar 3 suspending the anodized workpieces is transferred to third chain conveyor means 12 which may be substantially identical in construction to the first chain conveyor means 9. The receivers 54 of the third chain conveyor means 12 receive both ends of the carrier bar 3 and lift up the bar out of the electrolytic bath 10 along the path of chains 50. The conveyor 13, which may be of substantially identical construction to the conveyor 5, receives the carrier bar 3 from the third chain conveyor means 12 and transfers it to the conveyor means 14.

The enclosure means 15 for defining a dust free heating chamber includes front and rear walls 60 and 61, respectively, opposite side walls. A ceiling wall 62 is above a washing bath 63, a coating bath 16, and baking vessels 17, to cover upper portions thereof. The conveyor 18 is fixed to a lower end of the front wall 60, and it serves to receive a carrier bar 3 from the lifting means 14 out of the chamber and transport it to a vertically movable conveyor 64 in the chamber at a lower position of conveyor 64. Conveyor 64 then transports the carrier bar 3 vertically upwardly and transfers the bar to another conveyor 20 which carries the bar downwardly until the workpieces are dipped into the coating bath 16. After the coating process, the workpieces are lifted from the bath 16 by the conveyor 20. The vertically movable conveyor 20 is substantially identical to the lower crane 8 in the lifting means. The carrier bar 3 having thus-coated workpieces is then transferred to the next vertical conveyor 20 by which it is moved downwardly until the workpieces suspended therefrom are placed in the baking vessel 17.

The conveyor 19 is at the lower end of the rear wall 61 and it serves to transport the carrier bar 3 having finished workpieces out of the chamber. The carrier bar 3 is then transferred to the longitudinal conveyor 21 which may be of substantially identical construction to the conveyor 5. The third lifting means 22 can be substantially identical in construction to the first lifting means 6 and cooperate with the longitudinal conveyor 21. When the third lifting means 22 is lowered with the carrier bar 3 thereon, the unloading frame 23, which is in the vertical position at this stage, receives the bar 3 in grooves 29 from the lifting means 22 and is then rotated into a horizontal position. In the horizontal position of the unloading frame 23, finished workpieces 2 are removed from the suspending devices 32 on the bar 3, and a belt conveyor transports the workpieces to the next station (not shown). The unloading frame 23 having an empty carrier bar 3 is then moved to a vertical position where the empty bar 3 is transferred to the third lifting means 22. Thereafter, the bar 3 is transported upwardly and transferred from the lifting means 22 to the returning conveyor 24 which may be of substantially identical construction to the longitudinal conveying means 5 except for the length thereof.

According to the present invention, the following merits are pointed out:

The productivity will be very improved due to continuous treatment of the workpieces, including pretreatment such as degreasing process. Secondly, various anodic films with colored or non-colored may be obtained by using sulfuric acid solution by changing voltages under successive electrodeposition process converting polarities.

Referring now to several examples:

EXAMPLE 1

Aluminum material A-1100 was treated in the bath 10 illustrated in FIG. 1 including 15 weight % sulfuric acid solution at the temperature of 20° C.±2. A direct wave current through a negative pole of aluminum plate was used under conditions of density range between 1.5–2 $A/dm^2$ and period for 5 minutes thereby to carry out degreasing treatment. After that, an anodizing treatment was performed according to the conditions in the Table on page 14. The results obtained also shown in the Table.

EXAMPLE 2–7

Similar to the Example 1, aluminum material A-1100 was first pretreated and then electrodeposited for anodic oxidation. The conditions and results obtained are shown in the Table below.

EXAMPLE 8

Aluminum material A-1100 was placed in the first bath from the left of the two baths referenced as 7 in FIG. 1, the bath including 5 weight % sodium hydroxide solution at temperature of 60° C. for a period of 1 minute. The material was then rinsed and neutralized in the second bath from the left of the two baths referenced as 7 in FIG. 1. The neutralization was carried out in 30% weight nitric acid solution at room temperature for 30 sec. The material was then anodized to form thereon oxidation. The conditions thereof and obtained results are shown in the Table below.

EXAMPLES 9–13

Similar to Example 8, aluminum material A-1100 was pretreated and then electrodeposited for anodic oxidation. The conditions and results are also shown in the Table below.

EXAMPLES 14–15

The same as Example 1, but the material to be treated was aluminum A-6063. Then the aluminum A-6063 to have been pretreated was electrodeposited for anodic oxidation. The conditions and results obtained are shown in the Table below.

EXAMPLES 16–18

The same as Example 8. But the material was was aluminum A-6063. The electrodeposition was carried out under the conditions shown in the Table below. The results obtained are also shown in the Table.

Comparison of A and B

Aluminum materials A-1100 and A-6063 were pretreated as in the previous examples and then were electrodeposited under the same conditions to the previous examples using direct wave current and carbon plate negative pole, voltage being 15 volts. The result are shown in the Table below.

| EXAMPLE | POLARITY CONVERSION TIME (SEC.) | ELECTRO DEPOSITION TIME (MIN.) | AVERAGE VOLTAGE (V) | COULOMB AMOUNT | COULOMB AMOUNT PER UNIT AREA | COULOMB AMOUNT PER POLARITY CONVERSION TIME | FILM THICKNESS MICRONS | COLOR TONE | FILM GENERATION (RATIO OF FILM THICKNESS TO COULOMBS/UNIT AREA.) |
|---|---|---|---|---|---|---|---|---|---|
| 1 | 5 | 15 | 15 | 40.07 | 123.45 | 0.7 | 1.7 | I(R) | 0.014 |
| 2 | 5 | 15 | 20 | 67.15 | 203.67 | 1.03 | 1.8 | G | 0.008 |
| 3 | 5 | 30 | 15 | 75.73 | 229.7 | 0.52 | 2.6 | I(LG) | 0.018 |
| 4 | 15 | 30 | 154 | 157.04 | 476.31 | 2.85 | 4.6 | I(LB) | 0.0097 |
| 5 | 15 | 30 | 20 | 291.60 | 884.44 | 5.50 | 7.4 | L Gr | 0.0088 |
| 6 | 30 | 60 | 25 | 889.9 | 2699.3 | 15.34 | 18.6 | Gr | 0.0069 |
| 7 | 5 | 30 | 20 | 146.97 | 447.77 | 1.04 | 3.2 | B Gr | 0.007 |
| 8 | 15 | 15 | 20 | 134.38 | 407.58 | 4.79 | 4.9 | B Gr | 0.012 |
| 9 | 15 | 15 | 25 | 269.154 | 816.32 | 10.76 | 8.4 | Gr | 0.010 |
| 10 | 30 | 30 | 25 | 496.1 | 1504.79 | 19.84 | 11.8 | Gr | 0.0078 |
| 11 | 15 | 60 | 154 | 274.3 | 831.97 | 2.46 | 5.3 | B Gr | 0.0064 |
| 12 | 15 | 60 | 20 | 495.5 | 1502.76 | 4.30 | 10.5 | Gr | 0.0070 |
| 13 | 15 | 60 | 25 | 669.4 | 2030.4 | 6.43 | 15.6 | Gr | 0.0077 |
| 14 | 30 | 15 | 20 | 166.15 | 503.94 | 11.07 | 4.7 | B Gr | 0.009 |
| 15 | 30 | 60 | 20 | 456.2 | 1383.71 | 7.86 | 10.4 | Gr | 0.0076 |
| 16 | 15 | 15 | 15 | 63.50 | 192.60 | 2.35 | 2.2 | | 0.011 |
| 17 | 15 | 30 | 25 | 493.81 | 1497.76 | 7.996 | 11.0 | Gr | 0.0073 |
| 18 | 30 | 30 | 15 | 156.3 | 474.07 | 5.389 | 5.3 | WI | 0.011 |
| A | — | 15 | DC15 | — | 702. | — | 3.5 | — | 0.0050 |
| B | — | 30 | DC15 | — | 1308.5 | — | 6.6 | — | 0.0050 |

(NOTE)
I: COLORLESS
R: RED
B: BLUE
G: GREEN
Gr: GRTAY CLOSE TO COLORLESS
L: CLEAR COLOR
W: FADE COLOR (MEASURED BY COLORIMETER)

For the purposes of eliminating the washing process before painting of the anodized materials, it is preferable to use an aqueous electrolyte containing amine of 1–15 weight % density, such as fatty organic primary amine of monoethanolamine, fatty organic secondary amine of ethylenediamine, diethanolamine or N-methyl ethanolamine, organic tertiary amine of triethanolamine, or quaternary ammonium salt of beef fat diamineethylene.

This is because water-soluble thermosetting resin, such as for example, acrylic acid, alkyd resin, melamine or copolymer of ester induction material containing fatty organic primary or secondary amine or quaternary ammonium salts is used as coating material and therefore rinsing may not be necessary before coating treatment.

It is necessary, however, to rinse when the electrolytic solution used contains sulfuric acid, oxalic acid, sulfosalicylic acid, etc. It should be noted that the concentration of amine in electrolyte solution may be different from that of coating materials. However, it may be preferable to accord them.

For example, when the sulfuric acid is used in the solution the concentration thereof is generally about 10 weight % having a temperature of about 50°–80° C. and period of about 5–8 min. While, when the treatment is carried out with degreasing, the solution is used under the conditions of temperature at 20° C. or more, about 10–20 weight % concentration of sulfuric acid solution, current being applied through a negative pole for period for about 1–7 min, preferably about 2–5 min. Further, this treatment is carried out using direct wave or pulse wave current under current density of 7 A/dm$^2$ or less, peak voltage $V_p$ of 5–95 V, base voltage $V_B$0–90 V, pulse width preferably of 16 msec.–5 mm, n value (cycle/pulse width) of 2–7. Under such conditions, treatment is carried out by converting each polarity for pre-treatment in predetermined times. When the pulse wave current is used, etching effect will be advanced.

This pre-treatment is carried out in the same bath to the anodic oxidation treatment, and therefore, working effect will be exceedingly developed. At any rate the material to be treated is continuously transferred during treatment.

We claim:

1. A process for effecting surface treatment of elongate aluminum workpieces suspended vertically in side-by-side relationship from carrier bars in an electrolytic bath comprising:

spacing a plurality of electric contact plates along at least one wall of the electrolytic bath and outside said bath, the plates differing alternately in polarity;

transferring successively the workpieces into the electrolytic bath:

degreasing the workpieces; and advancing the carrier bars across the spaced electric contact plates for carrying the workpieces through the bath while applying electrical energy from the contact plates through the carrier bars to the successive workpieces as opposite electrodes of different polarities for anodizing the workpieces, the polarities of the individual workpiece electrodes being reversed as the carrier bars are advanced from plate to plate, wherein the first electrical contact plate has a negative polarity and the workpieces are subjected to the electrical energy 2–500 times while reversing the polarities thereof each time, each workpiece continuously serving as a counter pole for each of the workpieces immediately preceding and succeeding, the total current flow being between the workpieces.

2. The process of claim 1 wherein the electrical energy is applied as direct current.

3. The process of claim 1 wherein the electrical energy is applied as pulse wave current.

4. The process of claim 1 wherein the polarity conversion period is about 0.2 sec. to 5 min.

5. The process of claim 1 wherein the polarity conversion period is about 10–30 secs.

6. An apparatus for effecting surface treatment of elongate aluminum workpieces suspended vertically in side-by-side relationship from carrier bars in an electrolytic bath, comprising:

incoming and outgoing transfer means for transporting the carrier bars into and out of the bath at the opposite ends of the bath, respectively, said transfer means including a pair of opposed vertically constructed endless chains having a plurality of receivers for detachably supporting the carrier bars;

means for advancing the elongate workpieces suspended from the bars in the bath between said incoming and outgoing transfer means, said advancing means including a pair of opposed endless chains disposed along the side walls of the bath;

electric contact plates of successively alternating polarity spaced along at least one side of said bath and outside said bath; and means, including conductive means for applying electric energy from said plates by means of the carrier bars to the workpieces, for utilizing the successive workpieces as opposite electrodes of different polarities and for cooperating with said contact plates to apply all the current flow between the workpieces, the polarities reversing as the carrier bars are advanced from plate to plate, each workpiece continuously serving as a counter pole for each of the immediately preceding and succeeding workpieces.

* * * * *